United States Patent [19]

Megelas

[11] 4,172,720

[45] Oct. 30, 1979

[54] FLAKED METAL POWDERS AND METHOD OF MAKING SAME

[75] Inventor: Michael Megelas, Clinton, N.J.

[73] Assignee: United States Bronze Powders, Inc., Flemington, N.J.

[21] Appl. No.: 922,483

[22] Filed: Jul. 6, 1978

[51] Int. Cl.[2] ..... B02C 17/16; B02C 23/16

[52] U.S. Cl. ..... 75/251; 241/15; 241/30; 241/46.15

[58] Field of Search ..... 75/251, 0.5 A, 0.5 AA, 75/0.5 AB, 0.5 R; 241/15, 30, 46.15

[56] References Cited

U.S. PATENT DOCUMENTS

| | | | |
|---|---|---|---|
| 2,002,891 | 5/1935 | Hall | 134/76 |
| 3,008,656 | 11/1961 | Weston | 241/30 |
| 3,238,048 | 3/1966 | Somers | 106/39 |
| 3,295,766 | 1/1967 | Tveter | 241/15 |
| 3,322,582 | 5/1967 | Morana | 149/5 |
| 3,353,753 | 11/1967 | Wolfgram | 241/15 |
| 3,360,203 | 12/1967 | Smoke et al. | 241/15 |
| 3,934,825 | 1/1976 | Delfosse et al. | 241/30 |
| 3,995,815 | 12/1976 | Megelas | 241/15 |

*Primary Examiner*—W. Stallard

*Attorney, Agent, or Firm*—Schwartz, Jeffery, Schwaab, Mack, Blumenthal & Koch

[57] ABSTRACT

The disclosure describes a method of making flaked metal powders having a narrow particle size distribution, a whiter color and a very high sparkle effect. A heterogeneous liquid system comprising an inert liquid and a lubricant and including a finely divided metal is subjected to attrition in an enclosure in which there are a plurality of attritive elements. An agitator is moved through the elements to displace those in its path. In this method, the weight ratio of attritive elements to finely divided metal is between 70:1 and 90:1, the weight ratio of finely divided metal to lubricant is between 100:1 to 20:1 and the weight ratio of inert liquid to finely divided metal is between 0.5:1 to 2.5:1. Flaked Al, Cu, brass, stainless steel, nickel, cupro nickel powders and the like are obtained by this method.

20 Claims, 6 Drawing Figures

Fig. 2
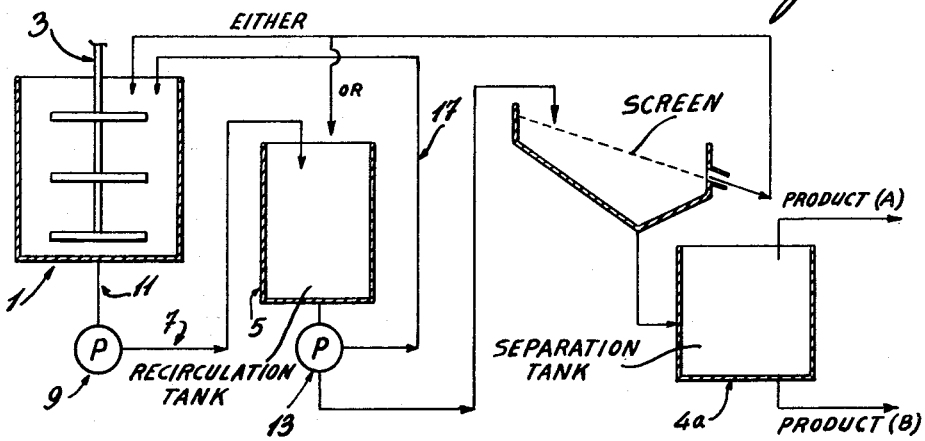
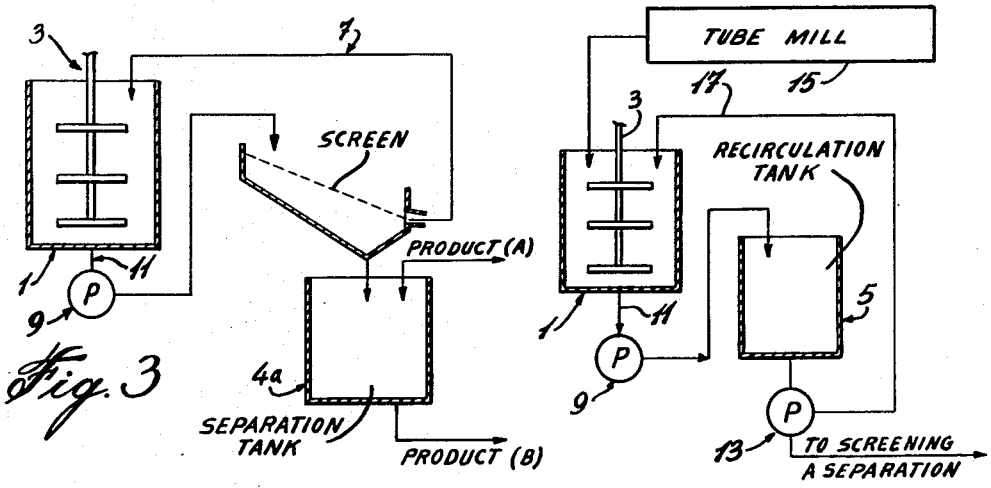
Fig. 3
Fig. 4
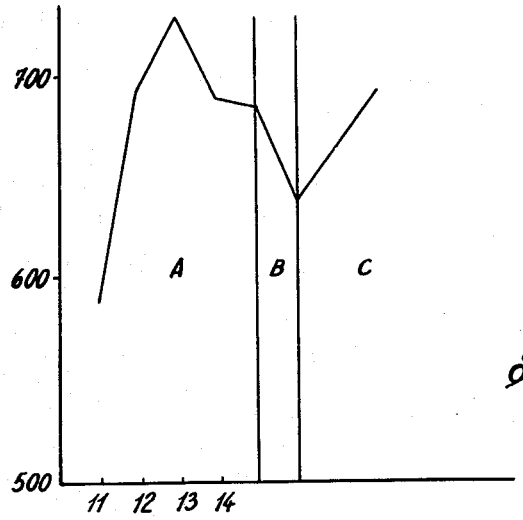
Fig. 5

FLAKED METAL POWDERS AND METHOD OF MAKING SAME

BACKGROUND OF THE INVENTION a. Field of the Invention

This invention relates to the production of flaked metal powders, especially those having a narrow particle size distribution, whiter color, and a very high sparkle effect. More particularly, the invention relates to aluminum, nickel, stainless steel, brass, cupro nickel, and bronze powders having the above characteristics.

b. Description of Prior Art

In my U.S. Pat. No. 3,995,815, entitled "PRODUCTION OF FLAKED METALLIC POWDERS" there is described a method of making these powders in which the ratio of attritive elements to finely divided metal is between 37:1 and 10:1 by weight. As a preferred condition, the ratio of inert liquid to finely divided metal is between 0.5:1 and 1:4 by weight and the ratio of finely divided metal to lubricant is between 30:1 and 1:1 by weight. Although this process has been found to be quite efficient, it is not possible to produce "flaked metal powders" with a narrow particle size distribution, an improved whiteness, and a very high sparkle effect as required in today's applications, such as in decorative finishes, automotive and appliance applications, paints, inks, plastics, and the like. Recently, there has been disclosed in U.S. Pat. No. 3,776,473 and its division U.S. Pat. No. 3,901,688, that it is possible to produce aluminum flaked powders with high specular reflectivity by the wet ball milling process. The process is carried out using grinding balls to powder a volume ratio which varies between about 15:1 and 75:1 and grinding balls to milling liquid volume ratio in the range of about 2:1 to about 1:1.25. This process is very uneconomical, time consuming and, although it produces powders of high sparkle, it has been found that its brightness is not sufficient in that when the pigment is treated, the powder is not sufficiently white. Furthermore, the size distribution is not narrow enough to fully satisfy modern requirements, such as in the automotive paint industry.

It has also been found that while the ratios of ingredients mentioned in U.S. Pat. No. 3,776,473 may be useful for tube mills, the products obtained with the equipment described in my U.S. Pat. No. 3,995,815 using the ratios defined in U.S. Pat. No. 3,776,473 are of very limited value because the fineness range makes them unacceptable.

SUMMARY OF THE INVENTION

The applicant has found that it is possible to obtain flaked metal powders having a narrow particle size distribution, an improved color and a very high sparkle effect using a combination of weight ratios for attritive elements to finely divided metal, finely divided metal to lubricant and inert liquid to finely divided metal which have not been disclosed in the prior art.

More particularly, the present invention relates to a method of making flaked metal powders with a narrow particle size distribution, an improved color, and a very high sparkle effect wherein a heterogenous liquid system comprising an inert liquid and a lubricant and including at least one finely divided metal capable of being flaked, is subjected to attrition in an enclosure in which there are a plurality of attritive elements, an agitator being moved through the elements to displace those in its path, wherein the weight ratio of attritive elements to finely divided metal is between 70:1 and 90:1, the weight ratio of finely divided metal to lubricant is between 100:1 to 20:1, and the weight ratio of inert liquid to finely divided metal is between 0.5:1 to 2.5:1.

The invention also relates to a method wherein said finely divided metal is aluminum.

The invention is also directed to a method wherein said finely divided metal is selected from the group consisting of copper, brass, bronze, stainless steel, nickel, cupro nickel.

The invention is further directed to a method wherein said attritive elements comprise metallic balls having diameters between about 0.8 mm and 25.0 mm.

BRIEF DESCRIPTION OF DRAWINGS

The invention is illustrated by means of the annexed drawing, in which:

FIG. 2 is a schematic illustration of a device according to another embodiment;

FIG. 3 is a schematic illustration of a device according to yet another embodiment;

FIG. 4 is a schematic illustration of a device according to a further embodiment; and FIG. 5 is a curve comparing the whiteness obtained using the present invention and the teaching of the prior art.

DESCRIPTION OF PREFERRED EMBODIMENTS

Figure 1A:
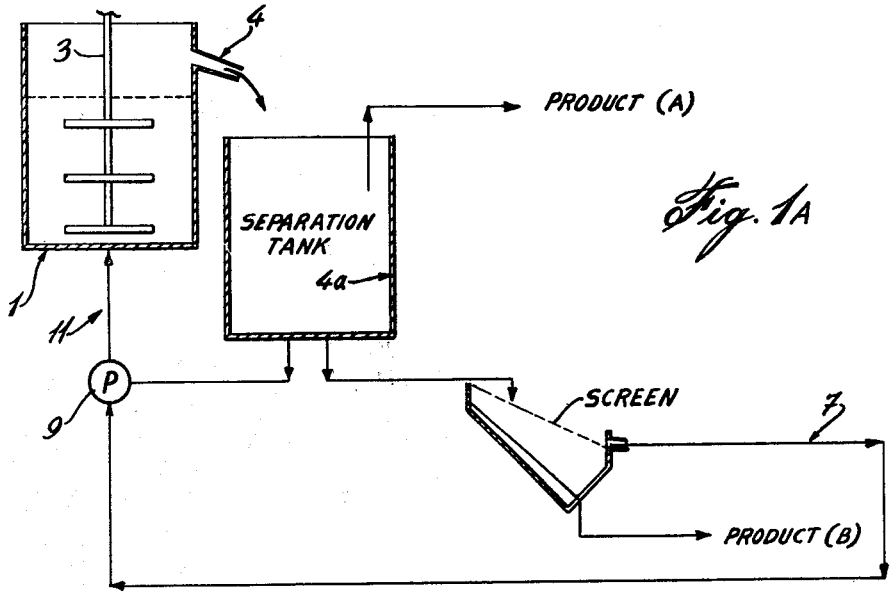
FIGS. 1A and 1B are schematic illustrations of devices used for the continuous recirculation of insufficiently flaked particles, with a bottom or top feed.

The production of flaked metal powders in accordance with the present invention can be carried out in a suitable apparatus, such as the one disclosed in my U.S. Pat. No. 3,995,815 dated Dec. 7, 1976. When utilizing such an apparatus, it will be realized that the agitator is made up of a plurality of rotating arms. It has been found to be advantageous if the attritive elements are present in the enclosure in an amount to substantially cover the uppermost arm. The attritive elements which are used preferably consist of suitable grinding media such as steel balls.

Preferably, the weight ratio of attritive elements to finely divided metal is about 78:1 to 85:1, the weight ratio of finely divided metal to lubricant is about 20:1 and the weight ratio of inert liquid to finely divided metal is about 0.5:1 to about 1:1, and the volume ratio of attritive elements to inert liquid is about 8:1.

Best results are obtained when the attrition lasts between about 5 minutes and about 120 minutes and when the temperature is maintained at between about 38° C. and about 50° C.

In accordance with a preferred embodiment, the volume ratio of attritive elements to inert liquid is preferably between 70:1 and 3:1.

Preferably, the weight ratio of inert liquid to finely divided metal is 0.5:1 to 2.0:1.

In accordance with yet another preferred embodiment of the invention, the weight ratio of attritive elements to finely divided metal is between 75:1 to 87:1, the weight ratio of finely divided metal to lubricant is between 30:1 to 20:1, the weight ratio of inert liquid to finely divided metal is between 0.5:1 to 1.5:1 and the volume ratio of attritive elements to inert liquid is 40:1 to 5:1.

In accordance with a preferred embodiment of the invention, a separate container is provided for the unfinished flaked metal powders. The flaked metal powders are continuously fed into this separate container and are recirculated from the separate container into the enclosure where grinding takes place, until a uniform size distribution is obtained.

Recirculation from the separate container to the enclosure can be carried out by any known means such as with a pump. The milled product is then pumped to a separation container from which one fraction is separated. The other fraction is further classified through a screen. The oversize is returned back to the enclosure for further milling.

According to another embodiment of the invention, after grinding the particles may be subjected to a preliminary screening step in order to separate the particles which have been milled to required size. The oversize particles can then be sent to the separate container from which they are pumped towards the enclosure for further milling. The screened particles are then pumped into a separation tank where they are further classified into at least two separate sizes: Product (A) and Product (B).

In accordance with another embodiment of the invention, the ground particles are pumped from the bottom part of the enclosure to be sent to the separate container where the uniform size flaked particles are separated and those which are insufficiently flaked are recirculated to the enclosure by means of a pump.

In accordance with another embodiment of the invention, the finely divided metal which is capable of being flaked has been subjected to a preliminary premilling treatment in a tube mill before being introduced in the enclosure.

In accordance with yet another embodiment of the invention, there is provided a suspension of the particles which have been subjected to attrition and flaked metal powders having a narrow particle size distribution are removed therefrom.

Although this method is applicable mostly to aluminum because of its commercial application, it is understood that it can also be used with copper, brass, bronze, stainless steel, nickel, cupro nickel, ferrochrome, etc. or any metal or alloy which could be flaked.

In accordance with yet another embodiment of the invention, the attritive elements which are used for grinding are made of metallic balls, preferably through hardened steel, having diameters between about 0.8 mm and 25.0 mm.

Referring to FIGS. 1 to 4 of the drawings, it will first of all be noted that the like parts in all the Figures are identified by the same references.

FIG. 1A illustrates an enclosure 1 in which there is an agitator 3. The enclosure 1 contains an inert liquid, a lubricant, a finely divided metal and grinding media such as steel balls. Flaked metal powders are produced by agitating the mixture by means of the agitator 3. The powders are then allowed to flow down through gravity via overflow drain 4, into a separation tank 4*a* from which the flaked metal powders having narrow particle size distribution are removed. The particles of a given size are removed using a separator or a screen as taught in my U.S. Pat. No. 3,995,815 and those which are insufficiently flaked are recirculated via duct 7, pump 9 and duct 11 where they are re-introduced into the enclosure 1 through the bottom thereof, in which a new attrition will take place in the enclosure 1.

Figure 1B:
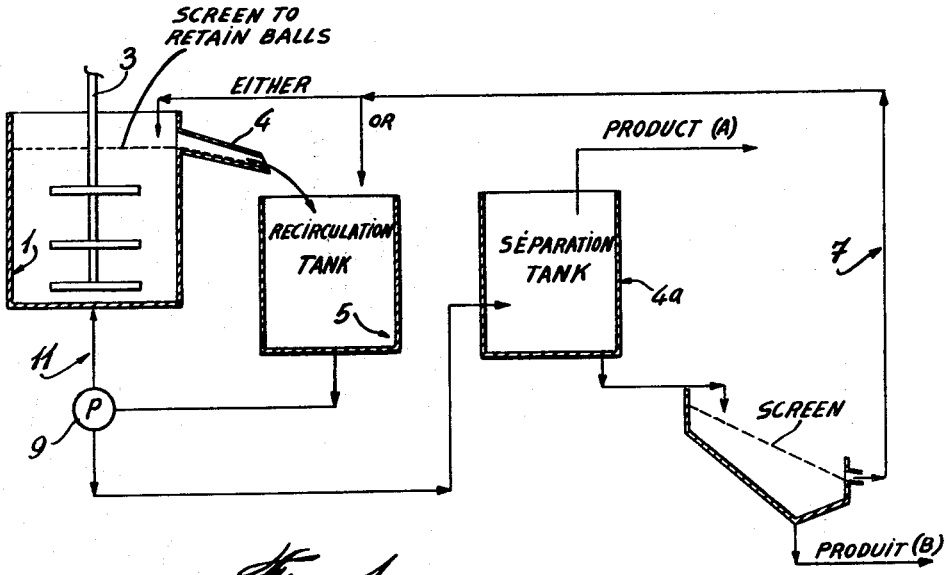

FIG. 1B is distinguished from FIG. 1A by the introduction of an unfinished product recycle Container 5. The unfinished flakes are continuously recycled in and out of the milling enclosure until a uniform particle size product is obtained. The slurry thus obtained is pumped to a separation container. At least one fraction of uniform size is separated. The rest is passed through a further classification equipment such as a screen. The larger particles which remain after screening are recycled to either the milling enclosure or to the recirculation container.

With reference to FIG. 2, the ground particles are pumped from the bottom part of the enclosure 1 via duct 11, pump 9 and duct 7, to be sent to the recirculation tank 5 where the insufficiently flaked particles are continuously returned to the milling enclosure until completely milled. The product thereof is separated as taught in my U.S. Pat. No. 3,995,815, and those which are insufficiently flaked are recirculated to either the enclosure at the top thereof via duct 17, pump 13 and another duct 19. The screened product can then be introduced into the separation container 5 from where at least two uniform particle size fractions could be obtained.

With reference to FIG. 3, it will be seen that the particles, after grinding, may be subjected to a preliminary screening step, in order to separate the particles which have been milled to required size. These particles can then be sent into a separation container for further classification to at least two products. The oversize particles can then be sent to the enclosure 1 as in the embodiment illustrated in FIG. 2.

Turning now to FIG. 4, the finely divided metal which is capable of being flaked is subjected to a preliminary treatment in tube mill 15 before being introduced into the enclosure 1.

The invention will now be illustrated by means of the following examples.

EXAMPLE I

A flaking means as described in U.S. Pat. No. 3,995,815 was used. The total volume of the container used was 2 gal. The speed setting for the rotating arm throughout the present test series was kept at 185 RPM to standardize the test conditions. Other speed settings could also be used with slight modifications in the other ratios as may be appreciated by anyone skilled in the art. The inert fluid used was Varsol* which is a petroleum distillate fraction having a specific gravity of approximately 0.779 gm/cc. The lubricant used was stearic acid to produce leafing pigments. The feed material used was either atomized or cut foil as per teachings in my above-mentioned U.S. patent. The attritive elements size used were also standardized to reduce the number of parameters under consideration. The size was ⅛" or 3.175 mm steel balls.

*trademark

The time was varied between 5 minutes and 120 minutes. In all cases, it was kept at not more than 120 minutes, as other tests done with longer times produced products which were unsuitable for the present purpose of obtaining a high sparkle.

The series of tests made according to the procedure is tabulated below as TABLE I.

TABLE I

| Test No. | B/M (weight) | Liq./M (weight) | B/Liq. (volume) | M/Lub. | Metal | Milling Time (minutes) | $Cm^2/g$ water/ coverage (−400 mesh) | Colormaster MEECO (whiteness) |
|---|---|---|---|---|---|---|---|---|
| 1 | 89 | 2.167 | 6.413 | 20 | Al | 15 | 2940 | 65.31 |
| 2 | 87 | 2.167 | 6.269 | 20 | Al | 15 | 2820 | 66.19 |
| 3 | 85 | 2.167 | 6.125 | 20 | Al | 15 | 4940 | 69.53 |
| 4 | 83 | 2.167 | 5.981 | 20 | Al | 15 | 4500 | 68.03 |
| 5 | 78 | 2.167 | 5.621 | 20 | Al | 15 | 4920 | 68.70 |
| 6 | 75 | 2.167 | 5.404 | 20 | Al | 15 | 2325 | 63.72 |
| 7 | 70 | 2.167 | 5.044 | 20 | Al | 15 | 2560 | 65.03 |
| 8 | 87 | 2.0 | 6.792 | 20 | Al | 15 | 3100 | 69.59 |
| 9 | 85 | 2.0 | 6.636 | 20 | Al | 15 | 3075 | 66.75 |
| 10 | 75 | 2.0 | 5.856 | 20 | Al | 15 | 1980 | 63.03 |
| 11 | 85 | 2.0 | 6.636 | 20 | Al | 5 | 1575 | 60.63 |
| 12 | 85 | 2.0 | 6.636 | 20 | Al | 15 | 2625 | 69.41 |
| 13 | 85 | 2.0 | 6.636 | 20 | Al | 30 | 4650 | 73.07 |
| 14 | 85 | 2.0 | 6.636 | 20 | Al | 60 | 12000 | 68.94 |
| 15 | 85 | 2.0 | 6.636 | 20 | Al | 90 | 17400 | 69.55 |
| 16 | 85 | 2.0 | 6.636 | 20 | Al | 120 | 18300 | 62.72 |
| 17 | 85 | 2.0 | 6.636 | 20 | Al | 15 | 2430 | 64.28 |
| 18 | 85 | 2.0 | 6.636 | 20 | Al | 15 | 2370 | 61.82 |
| 19 | 85 | 2.0 | 6.636 | 20 | Al | 15 | 2835 | 64.18 |
| 20 | 85 | 2.0 | 6.636 | 20 | Al | 15 | 2445 | 65.71 |
| 21 | 89 | 2.0 | 6.947 | 20 | Al | 15 | 1770 | 63.41 |
| 22 | 83 | 2.0 | 6.480 | 20 | Al | 15 | 1860 | 64.91 |
| 23 | 78 | 2.0 | 6.09 | 20 | Al | 15 | 1965 | 60.11 |
| 24 | 70 | 2.0 | 5.47 | 20 | Al | 15 | 1995 | 62.85 |
| 25 | 85 | 1.0 | 13.27 | 20 | Al | 15 | 2790 | 69.21 |
| 26 | 78 | 1.0 | 12.18 | 20 | Al | 15 | 2670 | 61.77 |
| 27 | 85 | 0.25 | 53.08 | 20 | Al | 15 | 5010 | 67.83 |
| 28 | 78 | 0.25 | 48.70 | 20 | Al | 15 | 3840 | 69.86 |
| 29 | 85 | 2.0 | 6.64 | 20 | Ni | 15 | 4470 | — |
| 30 | 85 | 2.0 | 6.64 | 20 | Brass | 15 | 1350 | — |

Ball Diameter ⅛" = 3.0 mm
Temperature = 37°–50° C.

Test No. 1 was repeated by varying the metal to lubricant ratio from 20:1 to 40:1 to 60:1 to 80:1 to 100:1. No appreciable differences were observed in the resulting product.

Test No. 2 was repeated by varying the attritive elements to inert liquid ratio from 3:1 by volume to 53:1 by volume or from 19.5:1 to 340:1 by weight.

No appreciable differences were observed in the resulting product.

EXAMPLE II

Standard Conditions for Tube Milling were used with 3/16" (3.175 mm) steel balls in a ratio to the metal of 40:1 by weight. The inert suspending fluid (in this case Varsol*) ratio to metal was 1:1, and the metal to lubricant (stearic acid) ratio was 10:1. The temperature range was 105°–110° F. (40.6°–43.3° C.), and the Milling Time 2 hours. The speed of the agitators was the maximum possible (in this case 100 RPM). No attachment of prongs, rods or baffles was used. The resulting material displayed no flaking or leafing. The resulting product consisted of a wide assortment of particle sizes which impaired the high sparkle effect and rendered a poor color.

*trademark

EXAMPLE III

A flaking means as in Example I. The metal, lubricant, inert fluid, and flaking media ratios used were taken from prior art as applicable to tube mills.

The resulting product consisted of a wide assortment of particle sizes which impaired the high sparkle effect and rendered a poor color.

EXAMPLE IV

The flaking means were those described in Example I. The metal, lubricant, inert fluid and flaking media ratios, as well as the other conditions used were similar to Runs 1, 11 and 15 described in both U.S. Pat. Nos. 3,776,473 and 3,901,668 and are tabulated below.

Coarse products were obtained in spite of the extended time in Run 15. The quantity of metal to be flaked had to be reduced to accommodate the excessive volume of fluid used. Hence the ratios were of limited usefulness, very uneconomical, and did not yield an acceptable commercial range of products, unlike those products obtained through Example I above.

TABLE II

| Weight Ratios | Balls to Metal (weight) | Liquid to Metal (weight) | Metal to Lubricant (weight) | Ball to Liquid (volume) | W/ Coverage −400 mesh fraction) |
|---|---|---|---|---|---|
| Run #1 | 116.44:1 | 11.41:1 | 100:1 | 1:1 | 7440 |
| Run #11 | 87.36 | 8.56:1 | 100:1 | 1:1 | 6480 |
| Run #15 | 174.72 | 17.12:1 | 100:1 | 1:1 | 8340 |

These tests show the higher efficiency of the apparatus used in Example I. However the various combinations of ratios are still not completely satisfactory.

EXAMPLE V

Example I is repeated using other lubricants. The same results are obtained.

In FIG. 5, area A relates to compounds produced by the method of the invention. Area B relates to commercial products produced by the method according to U.S. Pat. No. 3,776,473 and U.S. Pat. No. 3,901,668. Area C represents products produced under the conditions of the above U.S. patents using the attritor of my U.S. Pat. No. 3,995,815.

With reference to FIG. 5, it will be observed that two commercial products produced by the method according to U.S. Pat. No. 3,776,473 and No. 3,901,668 are inferior insofar as whiteness in comparison to the products produced by the process according to the present invention under the conditions defined in tests Nos. 12, 13 and 14.

On the other hand, a product produced according to the method of U.S. Pat. No. 3,776,473 and U.S. Pat. No. 3,901,668, in the apparatus described in my U.S. Pat. No. 3,995,815 is superior to the commercial products produced by the method of U.S. Pat. No. 3,776,473 and No. 3,901,668. Also the product is of inferior quality to the ones obtained in tests Nos. 12 and 13.

I claim:

1. A method of making flaked metal powders having a narrow particle size distribution and a very high sparkle effect wherein a heterogenous liquid system comprising an inert liquid and a lubricant and including at least one finely divided metal capable of being flaked is subjected to attrition in an enclosure in which there are a plurality of attritive elements, an agitator being moved through the elements to displace those in its path, wherein the weight ratio of attritive elements to finely divided metal is between 70:1 and 90:1, the weight ratio of finely divided metal to lubricant is between 100:1 to 20:1 and the weight ratio of inert liquid to finely divided metal is between 0.5:1 to 2.5:1.

2. A method according to claim 1, wherein said agitator is made up of a plurality of rotating arms, said attritive elements are present in said enclosure in an amount sufficient to substantially cover the uppermost arm.

3. A method according to claim 1, wherein the volume ratio of attritive elements to inert liquid is between 70:1 and 3:1.

4. A method according to claim 1, wherein the weight ratio of inert liquid to finely divided metal is 0.5:1 to 2.0:1.

5. A method according to claim 3, wherein the weight ratio of attritive elements to finely divided metal is between 75:1 to 87:1, the weight ratio of finely divided metal to lubricant is 30:1 to 20:1, the weight ratio of inert liquid to finely divided metal is 0.5:1 to 1.5:1, the volume ratio of attritive elements to inert liquid is 40:1 to 5:1.

6. A method according to claim 3, wherein the weight ratio of attritive elements to finely divided metal is about 78:1 to 85:1, the weight ratio of finely divided metal to lubricant is about 20:1, the weight ratio of inert liquid to finely divided metal is about 0.5:1 to 1:1, and the volume ratio of attritive elements to inert liquid is about 8:1.

7. A method according to claim 2, wherein said attrition lasts between about 5 minutes and about 120 minutes and is carried out at a temperature between about 37° C. and about 50° C.

8. A method according to claim 1, wherein a separate container is provided for the finished flake metal particles, and comprising the step of feeding said flake metal particles into said separate container and recirculating insufficiently flaked particles into said enclosure, until a uniform size distribution is obtained.

9. A method according to claim 6, wherein said insufficiently flaked particles are recirculated into said enclosure by means of a pump.

10. A method according to claim 8, wherein after grinding the particles are subjected to a preliminary screening step in order to separate the particles which have been milled to required size, while oversize particles are sent to the separate container from which they are pumped towards the enclosure for further milling.

11. A method according to claim 8, wherein ground particles are pumped from the bottom part of the enclosure to be sent to the separate container where the uniform size flaked particles are separated and those which are insufficiently flaked are recirculated to the enclosure by means of a second pump.

12. A method according to claim 1, wherein said finely divided metal capable of being flaked has been pre-milled in a tube mill before being introduced in said enclosure.

13. A method according to claim 1, wherein said finely divided metal is aluminum.

14. A method according to claim 1, wherein said finely divided metal is selected from the group consisting of copper, brass, bronze, stainless steel, nickel, cupro nickel.

15. A method according to claim 1, wherein said attritive elements comprise metallic balls having diameters between about 0.8 mm and 25.0 mm.

16. A method according to claim 1, which comprises suspending particles which have been subjected to attrition and removing therefrom flaked metal powders having a narrow particle size distribution.

17. Flaked aluminum powders having a narrow particle size distribution and a very high sparkle effect, having color whiteness readings between about 69 and 74, after screening, as measured by the Colormaster V, manufactured by MEECO, and, also after screening, having a high uniformity of particles as established by the fact that they contain no more than 0.1% of +325 Mesh particles (44 microns).

18. Flaked nickel powders having a narrow particle size distribution and very high sparkle effect, after screening, a water coverage of between about 3000 and 5000 $cm^2/g$ as measured by the method described in "Aluminum Paint and Powder" by Edwards & Roy, Reinhold Publishing Company (1955), pp. 39, 40 and 41, and also after screening, having a high uniformity of particles as established by the fact that they contain no more than 0.1%, of +325 Mesh particles (44 microns).

19. Flaked brass powders having a narrow particle size distribution and very high sparkle effect, after screening, a water coverage of between about 1000 and 5000 $cm^2/g$ as measured by the method described in "Aluminum Paint and Powder" by Edwards & Roy, Reinhold Publishing Company (1955), pp. 39, 40 and 41, and also after screening having a high uniformity of particles as established by the fact that they contain no more than 0.1%, of +325 Mesh particles (44 microns).

20. Flaked aluminum powders according to claim 16, having a water coverage of between about 1575 and 12,000 $cm^2/g$ as measured by the method described in "Aluminum Paint and Powder" by Edwards & Roy, Reinhold Publishing Company (1955), pp. 39, 40 and 41.

* * * * *